US012798747B2

(12) United States Patent
Curcio

(10) Patent No.: US 12,798,747 B2
(45) Date of Patent: Nov. 17, 2026

(54) STEERING-SUPPORT SYSTEM FOR MARINE VESSELS

(71) Applicant: Mario Curcio, Hochdorf (CH)

(72) Inventor: Mario Curcio, Hochdorf (CH)

( * ) Notice: Subject to any disclaimer, the term of this patent is extended or adjusted under 35 U.S.C. 154(b) by 264 days.

(21) Appl. No.: 18/718,036

(22) PCT Filed: Jan. 8, 2023

(86) PCT No.: PCT/EP2023/050251
§ 371 (c)(1),
(2) Date: Jun. 9, 2024

(87) PCT Pub. No.: WO2023/131689
PCT Pub. Date: Jul. 13, 2023

(65) Prior Publication Data

US 2025/0042527 A1 Feb. 6, 2025

(30) Foreign Application Priority Data

Jan. 9, 2022 (EP) ..... 22020002

(51) Int. Cl.
*B63H 21/21* (2006.01)
*B63H 25/38* (2006.01)

(52) U.S. Cl.
CPC ..... *B63H 21/21* (2013.01); *B63H 25/38* (2013.01); *B63H 2021/216* (2013.01)

(58) Field of Classification Search
CPC ... B63H 21/21; B63H 25/38; B63H 2021/216
See application file for complete search history.

(56) References Cited

U.S. PATENT DOCUMENTS 5,235,927 A * 8/1993 Singh ..... G05D 1/0061 318/588
2017/0205828 A1* 7/2017 Estabrook ..... B63H 25/12

FOREIGN PATENT DOCUMENTS

| | | | | |
|---|---|---|---|---|
| EP | 3210878 | A1 | 8/2017 | |
| FR | 2746363 | A1 * | 9/1997 | ..... B63H 25/08 |
| JP | 2014118059 | A | 6/2014 | |
| WO | 2018123947 | A1 | 7/2018 | |
| WO | 2022175502 | | 8/2022 | |

* cited by examiner

*Primary Examiner* — Stephen P Avila
(74) *Attorney, Agent, or Firm* — Taft Stettinius & Hollister LLP

(57) ABSTRACT

A marine vessel comprising a steering-support system for facilitating manual steering of a marine vessel comprising motors and independent manual throttle and shift control units, rudders and manual rudder-steering means mechanically and/or hydraulically connected to the rudders for direct rudder-angle control. The steering-support system comprises electronic rudder-angle reset means connected to at least one automated rudder drive unit, which, when activated, disables use of the manual rudder-steering means and automatically controls the rudder drive unit to steer the rudders from any current off-center position to a mid position at which the rudders are parallel to a longitudinal axis of the vessel and to block the rudders at this mid position, thereby enabling steering of the marine vessel solely by the manual throttle and shift control units in absence of rudder influence on steering.

7 Claims, 2 Drawing Sheets

[Fig. 1]
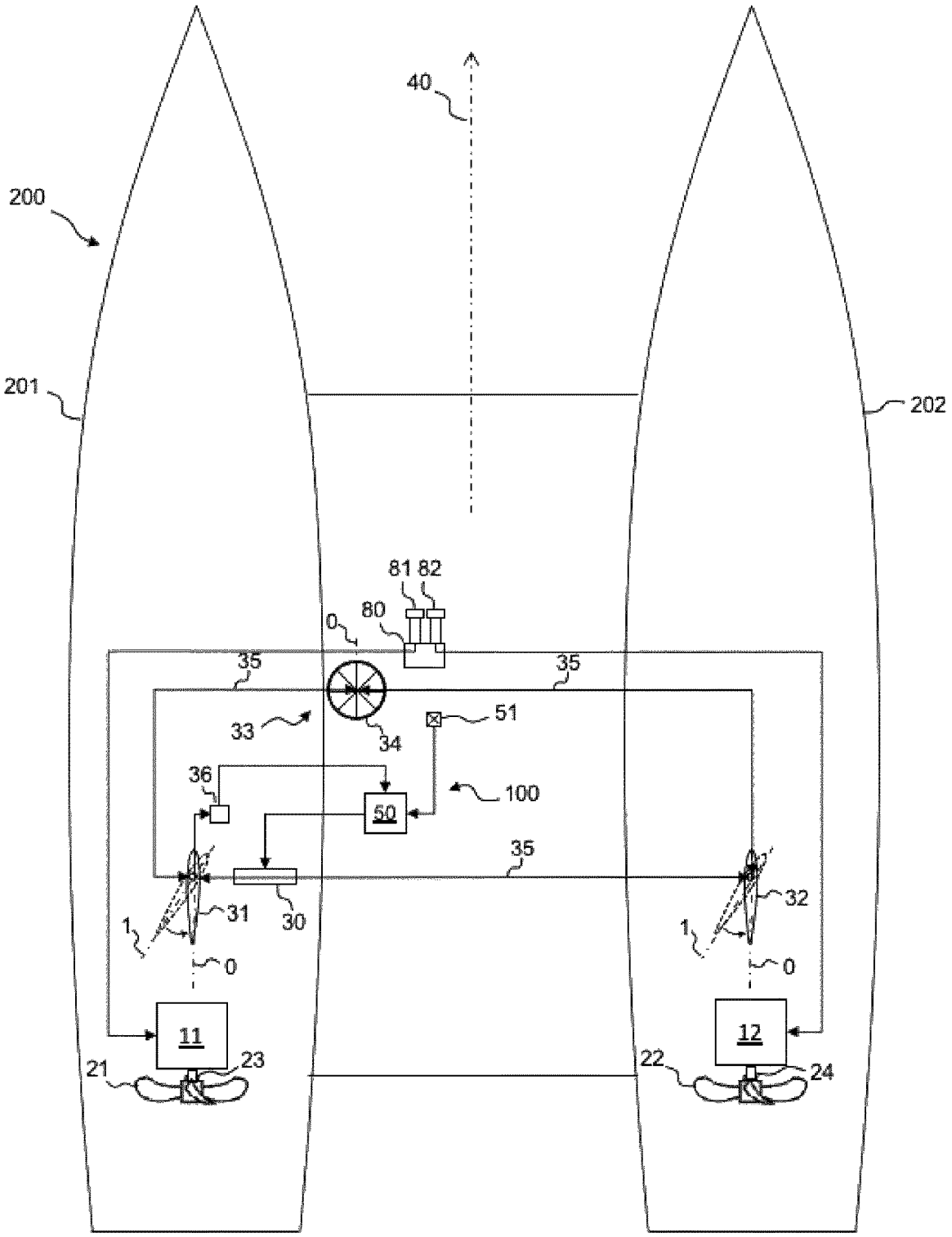

[Fig. 2]
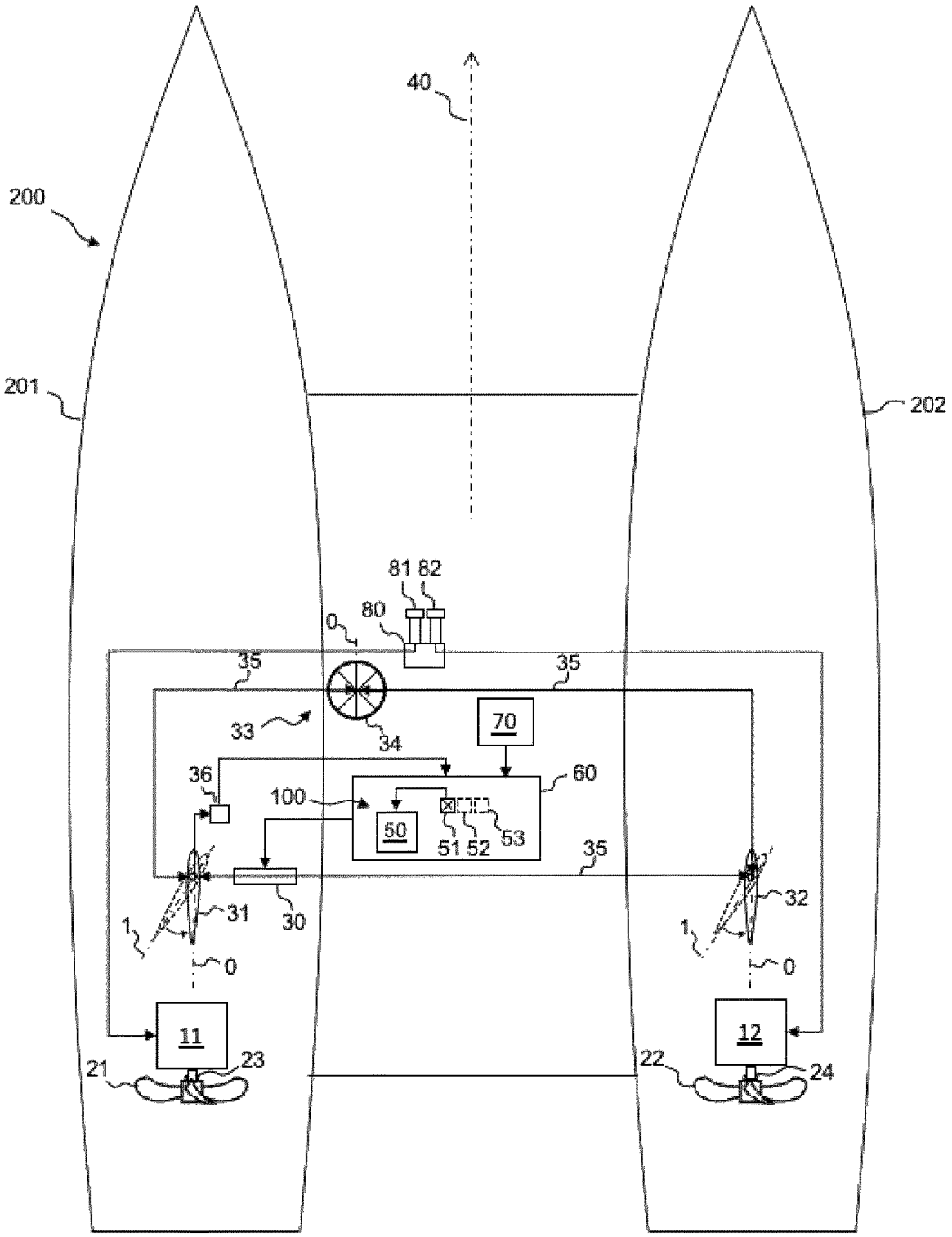

STEERING-SUPPORT SYSTEM FOR MARINE VESSELS

FIELD OF THE INVENTION

The present disclosure relates to a steering-support system for facilitating steering of a marine vessel, to an autopilot system comprising the steering-support system, to a marine vessel comprising the steering-support system and to a method of facilitating steering of a marine vessel.

BACKGROUND

Marine vessels may be provided with various propulsion systems. Some vessels have a single engine connected to a single propeller and direction is controlled by rudder steering using either one or two rudders. Other marine vessels may be provided with two engines and also two rudders on the port side and on the starboard side respectively. This is typical especially for multihull vessels such as catamarans. Other marine vessels may not have a rudder at all. In order to control direction, the propulsion systems can be rotatable about a steering axis, e.g. comprising a saildrive transmission system comprising a vertical rotatable intermediate shaft extending downward through a bottom surface of the hull or hulls of the marine vessel. Similarly, rotating outboards engines hanging at the stern of the vessel can be used in other types of vessels. Such rotating propulsion systems may be however not suitable or not preferred for some types of vessels, they can be structurally more complex and require more maintenance compared to propulsion systems with fixed axes, which however require an additional rudder-steering system for direction control.

Maneuvering and steering of a marine vessel may be facilitated by a bow thruster and an automated electronic control system that can enable to move a vessel in nearly any direction, including sideways, in response to a simple directional command. Most vessels do not however include such a system and maneuvering is typically performed by manual rudder and motor control, which requires manual skills and experience, the larger the vessel the higher the degree of difficulty.

Rudders can be subject to significant hydrodynamic forces during navigation and during maneuvering of a vessel. These forces typically depend on shape, size and position of the rudders, as well as on the shape, size and position of the propellers among numerous other factors. It is for example known that the forces and moments acting on a rudder located aft with respect to a propeller are different compared to the forces and moments acting on a rudder being located forward with respect to the propeller. The position of a rudder with respect to the propeller can play an important role especially when maneuvering a vessel in reverse and in general when reversing the direction of propulsion of the propeller. For example, when the rudder is located forward with respect to the propeller, the hydrodynamic forces acting on a rudder during forward movement of the vessel are low at lower speeds and the rudder has a lower impact on steering at these lower speeds. Also, steering the rudder mechanically and/or hydraulically by manual rudder-steering means such as a steering wheel, requires less manual force. However, as soon as the direction of propulsion is inverted, the hydrodynamic forces acting on the rudder located forward with respect to the propeller are higher even at low speeds, the impact of the rudder on steering is higher and manually steering the rudder requires much higher force. In particular, it can be very difficult to manually control the rudder angle and to maintain the desired angle. This is because the axis of rotation of the rudder is always located on the forward side of the rudder and as the rudder is subject to the strong hydrodynamic forces of the propeller in reverse mode it tends to rotate to the maximum widespread angle either port side or starboard side depending on whether at the time of reverse it was even slightly on one or the other side. When holding the steering wheel during reversing of propulsion the forces mechanically and/or hydraulically transferred from the rudder to the steering wheel can be so high that the wheel rotates abruptly and can escape from manual control. Besides being challenging maintaining control, maintaining the desired rudder angle and the desired steering effect, it can be also dangerous as the abrupt movement of the steering wheel can also cause injuries as well as potentially lead to accidents when maneuvering in narrow spaces such as in marinas due to failure of achieving the intended steering.

Maneuvering a marine vessel with two engines and independent throttle and shift control, especially if the engines are spaced relatively far apart from each other like on a catamaran, can be otherwise relatively simple. For example, it is possible, at least in favorable weather conditions, e.g. in absence of strong wind, to make a catamaran rotate on spot by 360° by having one propulsor in forward mode and the other in reverse mode.

Typically, in order to minimize the above-mentioned rudder effects and problems, the steering wheel can be blocked with the rudders in the mid position before starting the maneuver and then use manual throttle and shift control only. The mid position can be determined e.g. by a sign placed on the steering wheel and/or by a rudder-angle indicator connected to a rudder-angle feedback sensor. Blocking of the steering wheel is typically done by mechanical means such as tightening a screw around the rotating axis of the steering wheel. However, the hydrodynamic forces on the rudders can be so strong that these mechanical means may not be sufficient to keep the steering wheel blocked and/or can cause damage to the steering system. Also, adding the effect of the rudders for steering at least during part of the maneuver, e.g. during forward movement and/or partial rotation before reversing, can be advantageous, as steering can be obtained more quickly and in a more controlled manner. Thus, blocking the manual rudder-steering means in advance is not always the best option, whereas blocking it during maneuvering, e.g. just before reversing direction of propulsion, e.g. during rotation of the marine vessel, including finding the mid position of the rudders and activating the block or holding manually the position, can be very challenging even for an experienced skipper, as the time window for execution of the right maneuver is typically short and the space typically narrow, while trying to counteract the effect of other factors such as momentum of the vessel, wind and stream.

General Description

In view of the above background, a steering-support system for facilitating manual steering of a marine vessel is herein disclosed that enables to switch at any time, even during maneuvering, from a manual rudder-steering mode to a sole throttle and shift control mode in absence of rudder influence on steering in a convenient, quick, precise, and safe manner. Other advantages will become apparent from the following description.

An autopilot system comprising such steering-support system and presenting the same advantages is herein also disclosed.

A marine vessel comprising such steering-support system and presenting the same advantages is herein also disclosed.

A method of facilitating steering of said marine vessel and presenting the same advantages is herein also disclosed.

A "marine vessel" according to the present disclosure is a vessel such as a boat, a yacht or any other floating vessel, either monohull or multihull, adapted for navigation on water, such as ocean, sea, lake, river, regardless of its use, e.g. as a leisure vessel, or for commercial or dedicated use, e.g. as a charter yacht, a fishing boat, etc. In particular, the marine vessel of the present disclosure can be a motor and/or sailing vessel comprising a port-side motor and a starboard-side motor respectively connected to a port-side propulsor and to a starboard-side propulsor, a throttle and shift control comprising two individual units for independent manual control of power supply to the port-side motor and to the starboard-side motor respectively and for independent manual control of propulsion direction of the port-side propulsor and of the starboard-side propulsor respectively, a port-side rudder and a starboard-side rudder and manual rudder-steering means mechanically and/or hydraulically connected to the rudders for direct rudder-angle control.

In particular, the steering-support system of the present disclosure comprises electronic rudder-angle reset means connected to at least one automated rudder drive unit, which, when activated, disables use of the manual rudder-steering means and automatically controls the at least one automated rudder drive unit to steer the rudders from any current off-center position to a mid position at which the rudders are parallel to a longitudinal axis of the vessel and to block the rudders at this mid position, thereby enabling steering of the marine vessel solely by the manual throttle and shift control units in absence of rudder influence on steering. This is different from the system disclosed in WO2022175502A1 in that the system disclosed therein refers to an autopilot system for automatically (not manually) steering a marine vessel, in which locking the rudders to a mid position (according to an embodiment) has the effect of reducing drag and thereby reducing power consumption and/or increasing speed in a motor-steering autopilot mode, while maintaining the vessel on course during navigation. Moreover, WO2022175502A1 teaches that, in the motor-steering autopilot mode, individual manual control of each motor by the throttle and shift control units is disabled.

The term "manual rudder-steering means" according to the present disclosure refers to an apparatus configured to transmit manual directional movement by a direct mechanic and/or hydraulic connection from a helm to the rudders in order to adjust the rudders angle and hence steer the vessel in an intended direction. Consequently, by such a mechanism, a force, e.g. a hydrodynamic force, acting on the rudders and causing a change of rudder angle can be transmitted back from the rudders to the helm. In other words, a manual movement of the manual rudder-steering means causes a movement of the rudders and, vice versa, a movement of the rudders causes a movement of the manual rudder-steering means. The helm typically comprises at least one steering wheel. Other vessels may comprise a steering bar or lever instead of a steering wheel. Thus, the manual rudder-steering means are distinguished from electronic means for rudder control, e.g. from electronic docking systems making use of electronic levers, joysticks or other digital directional commands configured to send an electric input or signal to the rudder drive unit(s) and to cause a movement of the rudders by the drive unit(s). Moreover, some marine vessels, especially larger vessels, equipped with such electronic means for rudder control, typically are not equipped with manual rudder-steering means at all.

The term "electronic rudder-angle reset means" refers to an electronically controlled device or control unit that, when activated, is configured to electronically control one or more automated rudder drive units, based on a feedback from one or more rudder-angle sensors and/or based on drive unit position feedback, in order to automatically adjust the rudders angle from any current off-center angle comprised between a maximum angle on the port side (negative angle) and a maximum angle on the starboard side (positive angle) to a zero angle or mid position at which the rudders are parallel to the longitudinal axis of the vessel, thereby resetting the rudder angle from a positive or negative angle to a zero angle or near-zero angle, provided a certain precision tolerance. The control unit is further configured to block and maintain the rudders blocked at this mid position or zero angle as long as this function remains active. In addition, while the function is active, use of the manual rudder-steering means is disabled. For example, while the rudders are being steered by the drive unit(s) to the mid position, this movement causes the steering wheel to rotate automatically until the mid position is reached and then to stop and remain steady once the mid position is reached and the drive unit(s) stop(s) moving. Blocking of the rudders may be achieved by simply maintaining the drive unit(s) in a stationary position and/or by activation of supplementary mechanical blocking means or brake preventing rotation of the rudders about their axes of rotation.

Activation of the electronic rudder-angle reset means may be achieved e.g. by an electronic command, such as but not limited to a switch or button located at the helm station. Deactivation and return to a manual rudder-steering mode may be achieved by pushing the same or a different command.

According to an embodiment, the at least one automated rudder drive unit connected to the rudder-angle reset means is the same rudder drive unit of an autopilot system.

An "autopilot system" as herein disclosed is an electronically controlled device, which can be configured to operate according to at least one autopilot mode. According to a conventional autopilot mode, the autopilot system is configured to automatically control and dynamically adjust the rudders angle, by controlling the one or more rudder drive units, based e.g. on a feedback from a navigation system or compass as well as from a feedback from one or more rudder-angle sensor(s) and/or drive unit position feedback, in order to automatically maintain the vessel on a set course during navigation, i.e. without manual steering.

In particular, the present disclosure refers also to an autopilot system comprising at least one automated rudder drive unit for automatic rudder-angle control when used in autopilot mode and further comprising said steering-support system, where the electronic rudder-angle reset means, when activated, is configured to take over control of the at least one automated rudder drive unit of the autopilot system. For example, the autopilot system may comprise a selection function with one or more selection switches for selecting between an autopilot mode, according to which the rudders angle is automatically adjusted for maintaining the vessel on a set course, a rudder-angle reset mode or steering-support mode, according to which the rudders are automatically adjusted to their mid position and maintained in that position and according to which steering is possible solely by manual throttle and shift control, and a standby mode with neither function activated, where selecting the standby mode results in the deactivation of any other mode and in a return to a manual rudder-steering mode. In both the autopilot mode and the steering-support mode the manual rudder-steering means is disabled while the rudder drive unit(s) take(s) control of the rudders. The steering-support system and the autopilot system may be independent from each other, except being connected to the same drive unit(s), in which case activation of one may deactivate the other and vice versa.

The present disclosure refers also to a marine vessel comprising a port-side motor and a starboard-side motor respectively connected to a port-side propulsor and to a starboard-side propulsor, a throttle and shift control comprising two individual units for independent manual control of power supply to the port-side motor and to the starboard-side motor respectively and for independent manual control of propulsion direction of the port-side propulsor and of the starboard-side propulsor respectively, a port-side rudder and a starboard-side rudder, and manual rudder-steering means mechanically and/or hydraulically connected to the rudders for direct rudder-angle control, the marine vessel further comprising a steering-support system or an autopilot system according to the present disclosure.

The term "propulsor" may refer to any rotatable propulsion device, which transforms rotational power into linear thrust by acting upon water. According to the present disclosure the propulsors are typically propellers and they are typically located aft at a fixed position and angle with respect to the vessel hull. According to an embodiment, the propellers are connected to the respective motors via respective propeller shafts or saildrives through the hull(s) of the vessel.

The port-side rudder and the starboard-side rudder may be located aft or forward with respect to the port-side propulsor and starboard-side propulsor respectively.

According to an embodiment the marine vessel is a catamaran provided with two hulls, a port-side hull and starboard-side hull respectively, and a motor connected to a respective propulsor for each hull. The motor can be any type of motor, including e.g. an internal combustion engine or an electric motor, regardless of the power source, e.g. a battery or a hydrogen-fuel-cell.

The present disclosure refers also to a method of facilitating manual steering of a marine vessel, the marine vessel comprising a port-side motor and a starboard-side motor respectively connected to a port-side propulsor and to a starboard-side propulsor, a throttle and shift control comprising two individual units for independent manual control of power supply to the port-side motor and to the starboard-side motor respectively and for independent manual control of propulsion direction of the port-side propulsor and of the starboard-side propulsor respectively, a port-side rudder and a starboard-side rudder, and manual rudder-steering means mechanically and/or hydraulically connected to the rudders for direct rudder-angle control, where upon activation of electronic rudder-angle reset means connected to at least one automated rudder drive unit, the method comprises automatically disabling use of the manual rudder-steering means and automatically controlling the at least one automated rudder drive unit to steer the rudders from any current off-center position to a mid position at which the rudders are parallel to a longitudinal axis of the vessel and to block the rudders at this mid position, thereby enabling steering of the marine vessel solely by the manual throttle and shift control units in absence of rudder influence on steering.

According to an embodiment, the method comprises integrating the steering-support system into an autopilot system and/or connecting the electronic rudder-angle reset means to the at least one automated rudder drive unit of an autopilot system in order to take control thereof upon activation of the electronic rudder-angle reset means.

Other and further objects, features and advantages will appear from the following description of exemplary embodiments and accompanying drawings, which serve to explain the principles more in detail.

BRIEF DESCRIPTION OF THE DRAWINGS

FIG. 1 shows schematically a marine vessel comprising a steering-support system and a method of facilitating manual steering of the marine vessel.

FIG. 2 shows schematically a variant of the marine vessel and method of [FIG. 1] comprising additionally an autopilot system.

Skilled artisans appreciate that elements in the figures are illustrated for simplicity and clarity and have not necessarily been drawn to scale. For example, the dimensions of some of the elements in the figures may be exaggerated relative to other elements whereas other elements may have been left out or represented in a reduced number in order to enhance clarity and improve understanding of the embodiments of the present disclosure.

DETAILED DESCRIPTION

FIG. 1 shows schematically a marine vessel 200 and in particular a catamaran with a port-side hull 201 and a starboard-side hull 202, comprising a port-side motor 11 and a starboard-side motor 12, respectively connected to a port-side propeller 21 and to a starboard-side propeller 22 via e.g. a saildrive transmission system comprising a vertical intermediate shaft extending downward through the respective hulls 201, 202 that connects to propeller shafts 23, 24 respectively. The rudders 31, 32 are located forward with respect to the propulsors 21, 22 respectively in this example. They may be located however also aft with respect to the propulsors 21, 22. The marine vessel 200 further comprises a throttle and shift control 80 comprising two individual units 81, 82 for independent manual control of power supply to the port-side motor 11 and to the starboard-side motor 12 respectively and for independent manual control of propulsion direction of the port-side propulsor 21 and of the starboard-side propulsor 22 respectively, a port-side rudder 31 and a starboard-side rudder 32 and manual rudder-steering means 33, in particular a steering wheel 34 as a helm with a direct mechanic and/or hydraulic connection 35 to the rudders 31, 32 for direct manual rudder-angle control via the steering wheel 34.

In particular, the marine vessel 200 further comprises a steering-support system 100 comprising electronic rudder-angle reset means 50 connected to an automated rudder drive unit 30, which, when activated, e.g. by electronic switch 51, disables use of the manual rudder-steering means 33 and automatically controls the rudder drive unit 30, based also on a feedback from a rudder-angle sensor 36, to steer the rudders 31, 32 from any current off-center angular position 1 (the rudders being represented by dashed lines at this position) to a mid angular position 0 at which the rudders 31, 32 are parallel to a longitudinal axis 40 of the vessel 200 and to block the rudders 31, 32 at this mid position 0, thereby enabling steering of the marine vessel 200 solely by the manual throttle and shift control units 81, 82 in absence of rudder influence on steering.

With continued reference to [FIG. 1] a method of facilitating manual steering of the marine vessel 200 is schematically also shown. In particular, upon activation 51 of the electronic rudder-angle reset means 50, the method comprises automatically disabling use of the manual rudder-steering means 33 and automatically controlling the drive unit 30 to steer the rudders 31, 32 from any current off-center position 1 to the mid position 0 at which the rudders 31, 32 are parallel to the longitudinal axis 40 of the vessel 200 and to block the rudders 31, 32 at this mid position 0, thereby enabling steering of the marine vessel 200 solely by the manual throttle and shift control units 81, 82 in absence of rudder influence on steering. Automatically steering the rudders 31, 32 to the mid position causes the steering wheel 34 to rotate automatically until the mid position 0 of the steering wheel 34 that corresponds to the mid position 0 of the rudders 31, 32 is reached and then to stop and to remain steady (firm) at this mid position 0, thus preventing manual movement, as long as the electronic rudder-angle reset means 50 remain activated. Deactivation of the electronic rudder-angle reset means 50 and a return to a manual rudder-steering mode may be achieved by pushing the same electronic switch 51 in this example.

FIG. 2 shows schematically a variant of the marine vessel 200 and method of [FIG. 1] where like features have like numbers. In particular, the marine vessel 200 additionally comprises an autopilot system 60. In particular, the rudder drive unit 30 is the same used also by the autopilot system 60 for automatic rudder-angle control when the autopilot system 60 is used in autopilot mode 52. The steering-support system 100 with the electronic rudder-angle reset means 50 is in this example integrated in the autopilot system 60 and is configured to take over control of the at least one rudder drive unit 30 of the autopilot system 60 when activated 51. The autopilot system 60 comprises in this example three selection switches 51, 52, 53 for selecting between an autopilot mode 52, according to which the rudders angle is automatically adjusted for maintaining the vessel 200 on a set course, e.g. based on feedback from a navigation system 70, a rudder-angle reset mode or steering-support mode 51, according to which the rudders 31, 32 are automatically adjusted to their mid position 0 and maintained in that position and according to which steering is possible solely by manual throttle and shift control 80, and a standby mode 53 with neither function 51, 52 activated, where selecting the standby mode 53 results in the deactivation of any other mode 51, 52 and in a return to a manual rudder-steering mode. In both the autopilot mode 52 and the steering-support mode 51 the manual rudder-steering means 30 is disabled while the rudder drive unit 30 takes control of the rudders 31, 32. With continued reference to [FIG. 2] and compared to the method of [FIG. 1], a method is here also shown comprising integrating the steering-support system 100 into an autopilot system 60 and connecting the electronic rudder-angle reset means 50 to the rudder drive unit 30 of the autopilot system 60 and taking control thereof upon activation 51 of the electronic rudder-angle reset means 50.

In the preceding specification, numerous specific details are set forth in order to provide a thorough understanding of the present disclosure. It will be apparent, however, to one having ordinary skill in the art that the specific details need not be employed to practice the present teaching. In other instances, well-known materials or methods have not been described in detail in order to avoid obscuring the present disclosure.

Particularly, modifications and variations of the disclosed embodiments are certainly possible in light of the above description. It is therefore to be understood, that within the scope of the appended claims, the invention may be practiced otherwise than as specifically devised in the above examples.

Reference throughout the preceding specification to "one embodiment", "an embodiment", "one example" or "an example", means that a particular feature, structure or characteristic described in connection with the embodiment or example is included in at least one embodiment. Thus, appearances of the phrases "in one embodiment", "in an embodiment", "one example" or "an example", in various places throughout this specification are not necessarily all referring to the same embodiment or example.

Furthermore, the particular features, structures, or characteristics may be combined in any suitable combinations and/or sub-combinations in one or more embodiments or examples.

The invention claimed is:

1. A marine vessel comprising a port-side motor and a starboard-side motor respectively connected to a port-side propulsor and to a starboard-side propulsor, a throttle and shift control comprising two individual units for independent manual control of power supply to the port-side motor and to the starboard-side motor respectively and for independent manual control of propulsion direction of the port-side propulsor and of the starboard-side propulsor respectively, a port-side rudder and a starboard-side rudder, and manual rudder-steering means mechanically and/or hydraulically connected to the rudders for direct rudder-angle control, the marine vessel further comprising a steering-support system for facilitating manual steering of the marine vessel, the steering-support system comprising electronic rudder-angle reset means connected to at least one automated rudder drive unit, which, when activated, disables use of the manual rudder-steering means and automatically controls the at least one automated rudder drive unit to steer the rudders from any current off-center position to a mid position at which the rudders are parallel to a longitudinal axis of the vessel and to block the rudders at this mid position, thereby enabling steering of the marine vessel solely by the manual throttle and shift control units in absence of rudder influence on steering.

2. The marine vessel according to claim 1 wherein the marine vessel is a catamaran.

3. A method of facilitating manual steering of a marine vessel, the marine vessel comprising a port-side motor and a starboard-side motor respectively connected to a port-side propulsor and to a starboard-side propulsor, a throttle and shift control comprising two individual units for independent manual control of power supply to the port-side motor and to the starboard-side motor respectively and for independent manual control of propulsion direction of the port-side propulsor and of the starboard-side propulsor respectively, a port-side rudder and a starboard-side rudder, and manual rudder-steering means mechanically and/or hydraulically connected to the rudders, for direct rudder-angle control, wherein upon activation of electronic rudder-angle reset means connected to at least one automated rudder drive unit, the method comprises automatically disabling use of the manual rudder-steering means and automatically controlling the at least one automated rudder drive unit to steer the rudders from any current off-center position to a mid position at which the rudders are parallel to a longitudinal axis of the vessel and to block the rudders at this mid position, thereby enabling steering of the marine vessel solely by the manual throttle and shift control units in absence of rudder influence on steering.

4. The method according to claim 3 comprising integrating a steering-support system comprising the electronic rudder-angle reset means into an autopilot system comprising the at least one automated rudder drive unit and/or connecting the electronic rudder-angle reset means to the at least one automated rudder drive unit of the autopilot system in order to take control thereof upon activation of the electronic rudder-angle reset means.

5. A marine vessel comprising a port-side motor and a starboard-side motor respectively connected to a port-side propulsor and to a starboard-side propulsor, a throttle and shift control comprising two individual units for independent manual control of power supply to the port-side motor and to the starboard-side motor respectively and for independent manual control of propulsion direction of the port-side propulsor and of the starboard-side propulsor respectively, a port-side rudder and a starboard-side rudder, and manual rudder-steering means mechanically and/or hydraulically connected to the rudders for direct rudder-angle control, the marine vessel further comprising an autopilot system comprising at least one automated rudder drive unit for automatic rudder-angle control when used in autopilot mode and a steering-support system for facilitating manual steering of the marine vessel, the steering-support system comprising electronic rudder-angle reset means connected to the at least one automated rudder drive unit, which, when activated, disables use of the manual rudder-steering means and automatically controls the at least one automated rudder drive unit to steer the rudders from any current off-center position to a mid position at which the rudders are parallel to a longitudinal axis of the vessel and to block the rudders at this mid position, thereby enabling steering of the marine vessel solely by the manual throttle and shift control units in absence of rudder influence on steering, wherein the electronic rudder-angle reset means, when activated, is configured to take over control of the at least one automated rudder drive unit of the autopilot system.

6. The marine vessel according to claim 5 wherein the autopilot system comprises a selection function with one or more selection switches for selecting between the autopilot mode, according to which the rudders angle is automatically adjusted for maintaining the vessel on a set course, a rudder-angle reset mode or steering-support mode, according to which the rudders are automatically adjusted to their mid position and maintained in that position and according to which steering is possible solely by manual throttle and shift control, and a standby mode with neither function activated, where selecting the standby mode results in the deactivation of any other mode and in a return to a manual rudder-steering mode.

7. The marine vessel according to claim 5 wherein the marine vessel is a catamaran.

* * * * *